US006942256B2

(12) United States Patent
Amy

(10) Patent No.: US 6,942,256 B2
(45) Date of Patent: Sep. 13, 2005

(54) DOOR CATCH

(76) Inventor: Ron Amy, P.O. Box 263, Penngrove, CA (US) 94951-0263

( * ) Notice: Subject to any disclaimer, the term of this patent is extended or adjusted under 35 U.S.C. 154(b) by 0 days.

(21) Appl. No.: 10/739,647

(22) Filed: Dec. 18, 2003

(65) Prior Publication Data

US 2005/0134051 A1 Jun. 23, 2005

(51) Int. Cl.[7] ..... E05C 19/10

(52) U.S. Cl. ..... 292/100; 292/202; 292/262; 292/275; 292/DIG. 56; 16/82; 403/115

(58) Field of Search ..... 292/275, DIG. 56, 292/DIG. 73, 100, DIG. 15, 202, 262; 16/82, 83; 403/90, 112, 114, 115, 122, 130

(56) References Cited

U.S. PATENT DOCUMENTS

| | | | | | |
|---|---|---|---|---|---|
| 326,373 | A | * | 9/1885 | Zimmerman | 292/262 |
| 924,081 | A | * | 6/1909 | Loev | 292/263 |
| 1,158,658 | A | * | 11/1915 | Ebert | 292/262 |
| 1,573,272 | A | * | 2/1926 | Phillips | 248/288.31 |
| 2,093,039 | A | * | 9/1937 | Eamon | 292/262 |
| 2,111,870 | A | * | 3/1938 | Nemec | 49/277 |
| 2,121,766 | A | * | 6/1938 | Wicks | 292/101 |
| 2,298,176 | A | * | 10/1942 | Nathan | 403/77 |
| 2,449,686 | A | * | 9/1948 | Brinda | 16/85 |
| 2,496,691 | A | * | 2/1950 | Berry | 292/251.5 |
| 2,885,237 | A | * | 5/1959 | Heyer | 292/70 |
| 3,086,803 | A | * | 4/1963 | Wilson | 292/17 |
| 3,212,740 | A | * | 10/1965 | Greenberg | 248/514 |
| 3,243,836 | A | * | 4/1966 | Reiss | 16/85 |
| 3,375,044 | A | * | 3/1968 | Peterson | 403/77 |
| 3,399,918 | A | * | 9/1968 | Nagy | 292/136 |
| 3,966,245 | A | * | 6/1976 | Losenno | 292/202 |
| 4,159,837 | A | * | 7/1979 | Morita | 292/127 |
| 4,302,864 | A | * | 12/1981 | Morita | 16/85 |
| 4,762,351 | A | * | 8/1988 | Bowman | 292/263 |
| 4,852,919 | A | * | 8/1989 | Nimee et al. | 292/251.5 |
| 5,241,725 | A | * | 9/1993 | Hamatani et al. | 16/82 |
| 5,273,326 | A | * | 12/1993 | Kinkaide | 292/272 |
| 5,899,167 | A | * | 5/1999 | Furman | 116/173 |
| 6,015,173 | A | * | 1/2000 | Shang | 292/288 |

* cited by examiner

*Primary Examiner*—Daniel P. Stodola
*Assistant Examiner*—Carlos Lugo
(74) *Attorney, Agent, or Firm*—Craig M. Stainbrook; Larry D. Johnson; Johnson & Stainbrook, LLP

(57) ABSTRACT

Door Catch with a catch retaining assembly and a catch. The catch assembly is comprised of a rigid first ball retaining mounting plate, a first ball, a concave disk, a rigid J shaped rod and a second ball retaining cup shape. The catch is comprised of a door mounting plate, an L shaped rod terminating at one end in the door mounting plate and at the opposite end in a second ball. The J shaped rod terminates at its top portion in the second ball retaining cup and at the lower portion in the first ball. The first ball retaining plate includes a centrally disposed concave ball retaining portion including a vertically disposed slot capable of receiving the J shaped rod. The ball retaining cup is capable of fitting snuggly over the the second ball so that no rattling can occur between the retaining cup and the the second ball.

3 Claims, 7 Drawing Sheets

DOOR CATCH

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of door catches and more specifically to a non rattling door catch.

Door catches are well known. They are used to help keep a door or the like in the open or closed position.

The most common form of door catch includes a first eye hook that radially retains a J shaped hook which can be screwed into a wall as well as a second eye hook that screws into a door or the like and can receive the end of the J shaped hook. These parts are typically made of formed rod like steel.

Although the standard J hook catch is effective in most cases, when used in a moving vehicle or vessel such as a recreational vehicle or a boat, the loose fit of the mating J hook and eye screw cause an annoying rattling sound.

BRIEF SUMMARY OF THE INVENTION

The primary object of the invention is to provide a door catch that does not rattle when in use on a moving vehicle or vessel such as a boat or recreational vehicle or aircraft or the like.

Another object of the invention is to provide a door catch that can retain a door in the open or closed position at a variety of parallel and non-parallel angles between a door and a wall or door frame.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a door catch comprising: a catch retainer assembly and a catch, said catch retainer assembly comprised of a rigid first ball retaining mounting plate, a first ball, a rigid J shaped rod and a second ball retaining cup shape, said catch comprised of a door mounting plate and an L shaped rod terminating at one end in said door mounting plate and at the opposite end in a second ball, said catch retainer assembly mounting plate and said catch mounting plate each including a plurality of screw receiving apertures, said J shaped rod terminating at its top portion in said second ball retaining cup and at the lower portion in said first ball, said first ball retaining plate including a centrally disposed concave ball retaining portion, said concave portion including a vertically disposed slot capable of receiving said J shaped rod, and said ball retaining cup capable of fitting snuggly over said second ball shape so that no rattling can occur between the said retaining cup and the said second ball.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
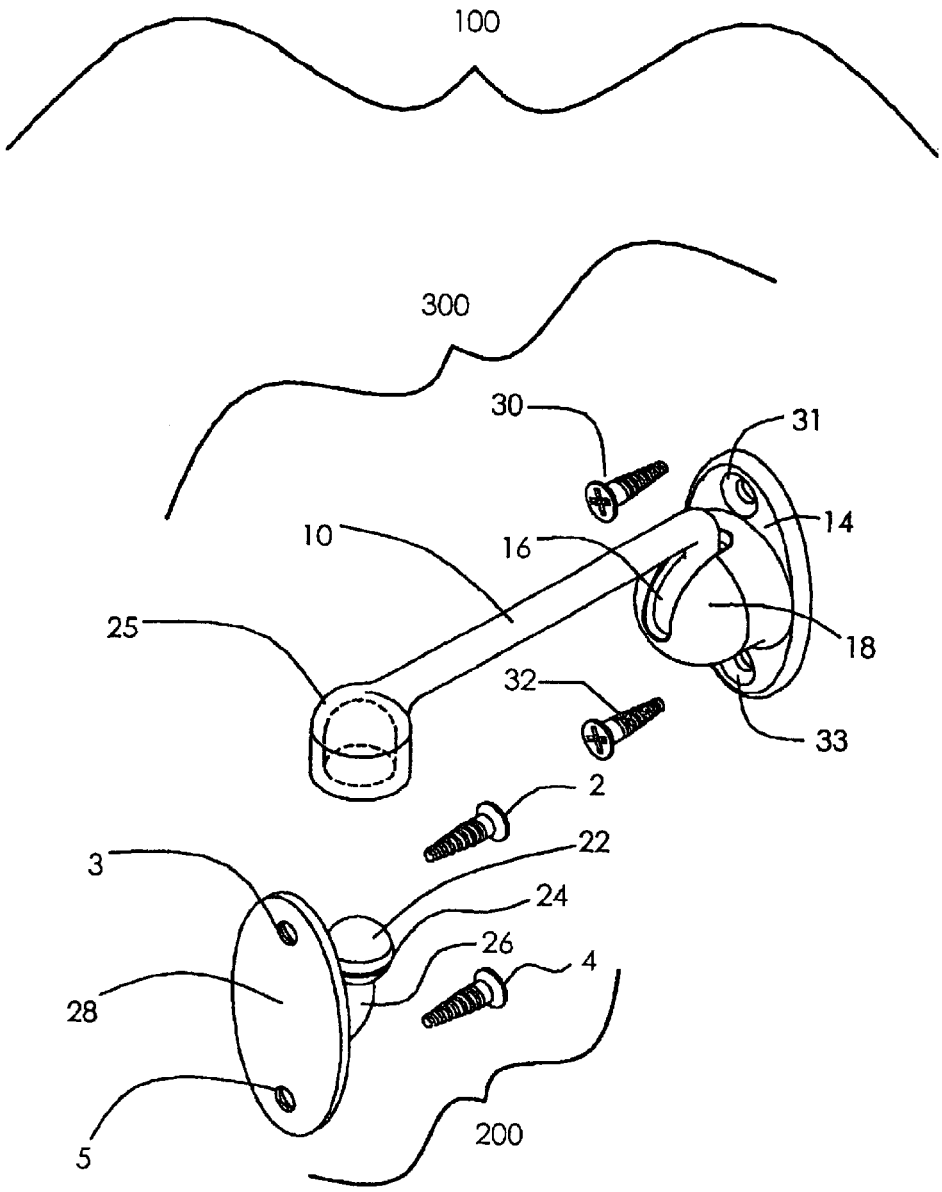
FIG. 1 is a perspective view of the catch and catch retainer of the invention.
Figure 2:
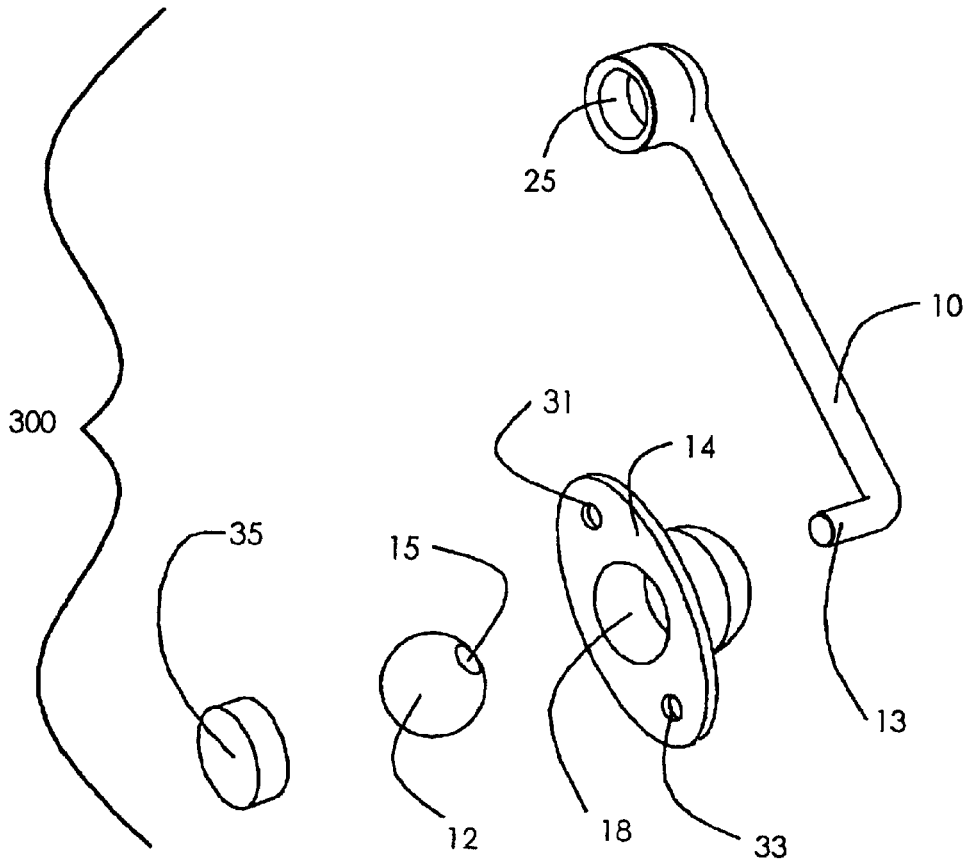
FIG. 2 is a perspective exploded view of the catch retainer assembly.
Figure 3:
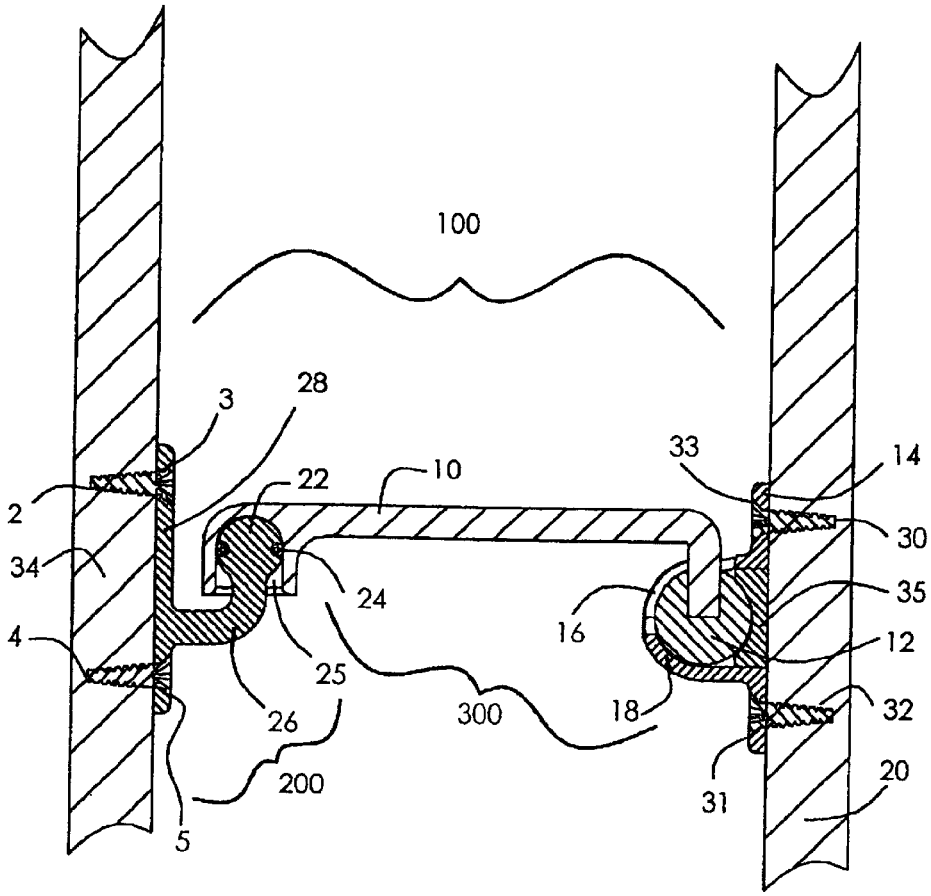
FIG. 3 is a side section view of the invention.
Figure 4:
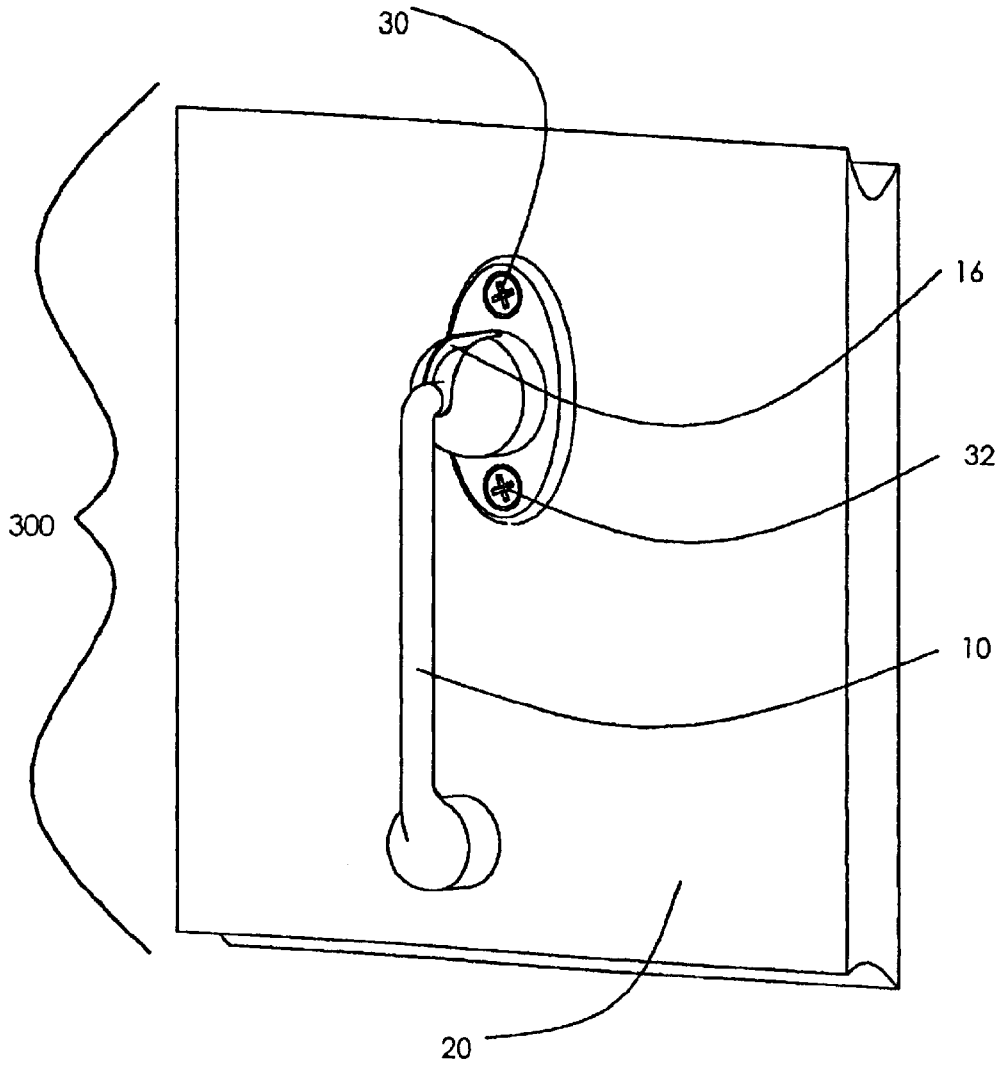
FIG. 4 is a perspective view of the catch retaining assembly rotated down in the non use position.
Figure 5:
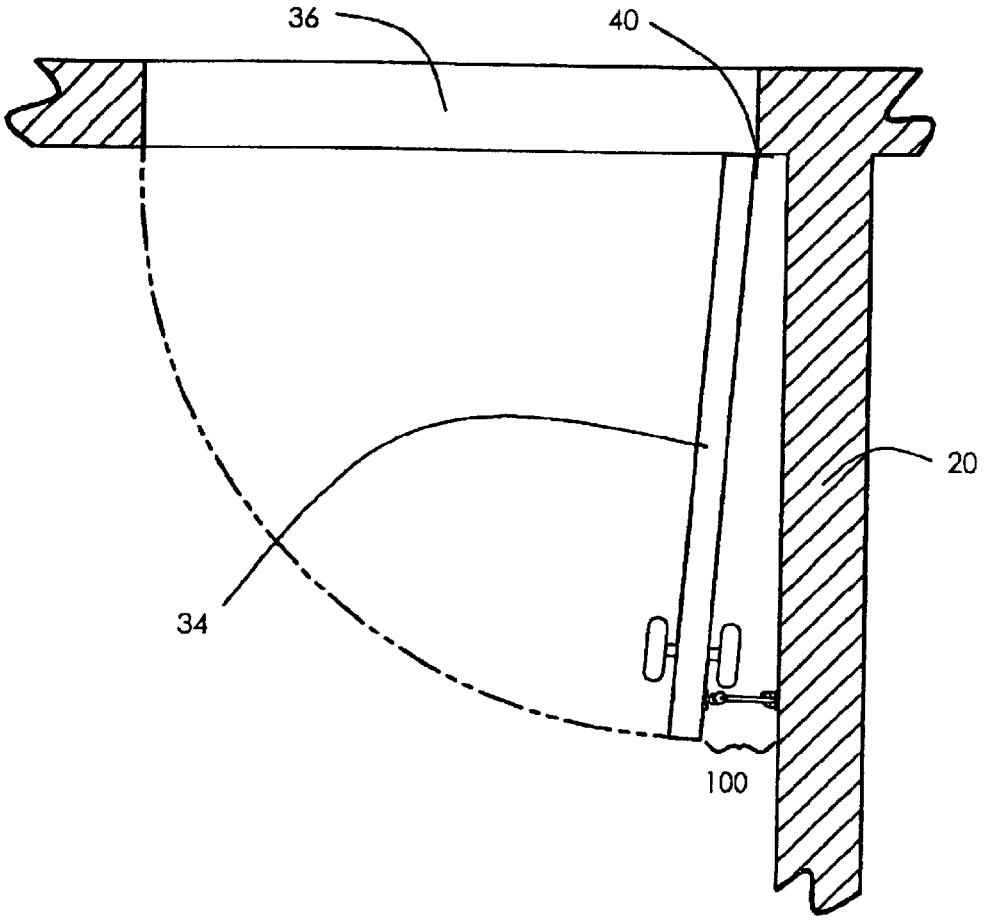
FIG. 5 is a top view of the present invention in place on a door and a wall.
Figure 6:
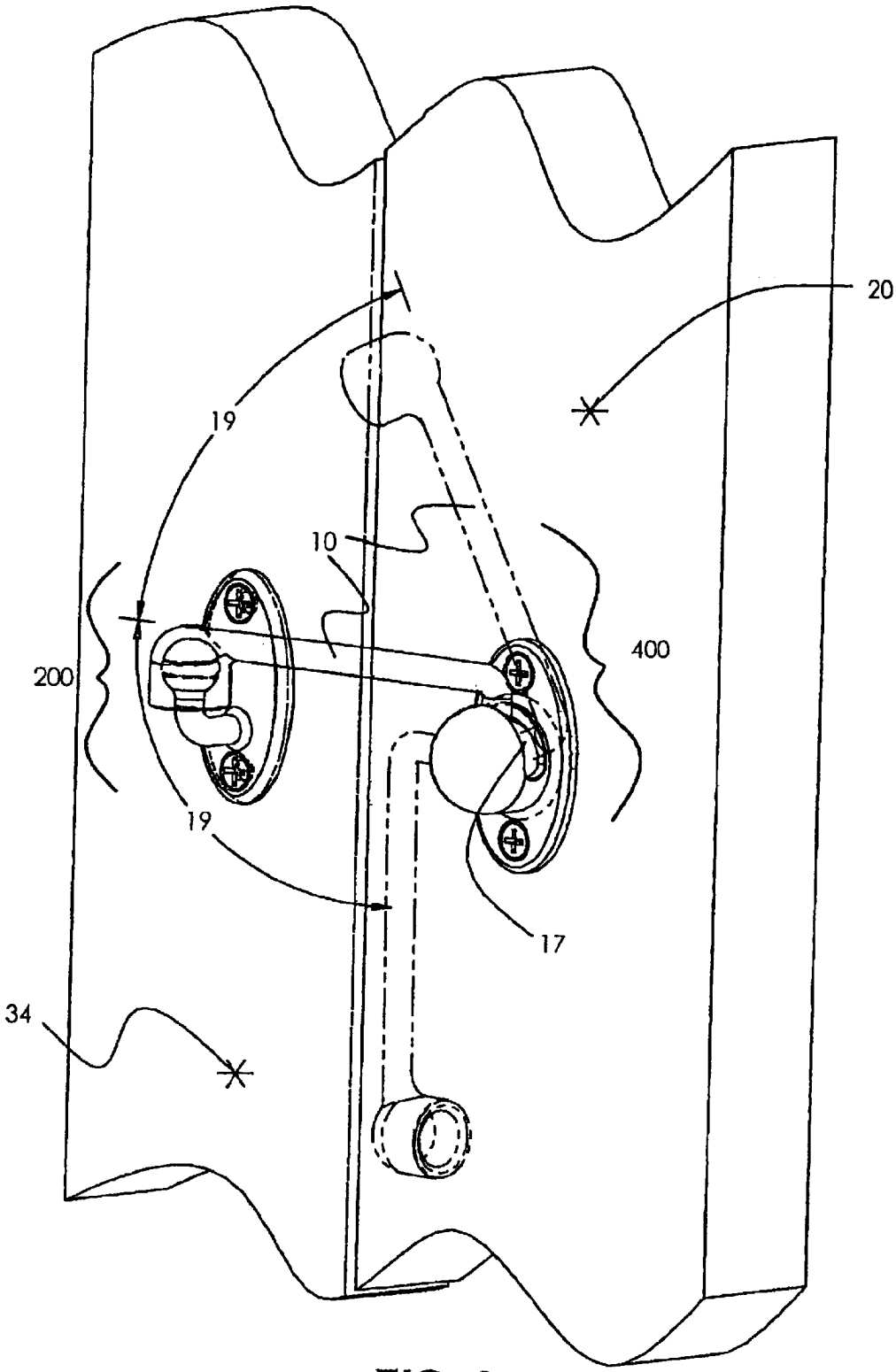
FIG. 6 is a perspective view of a latch version of the invention.
Figure 7:
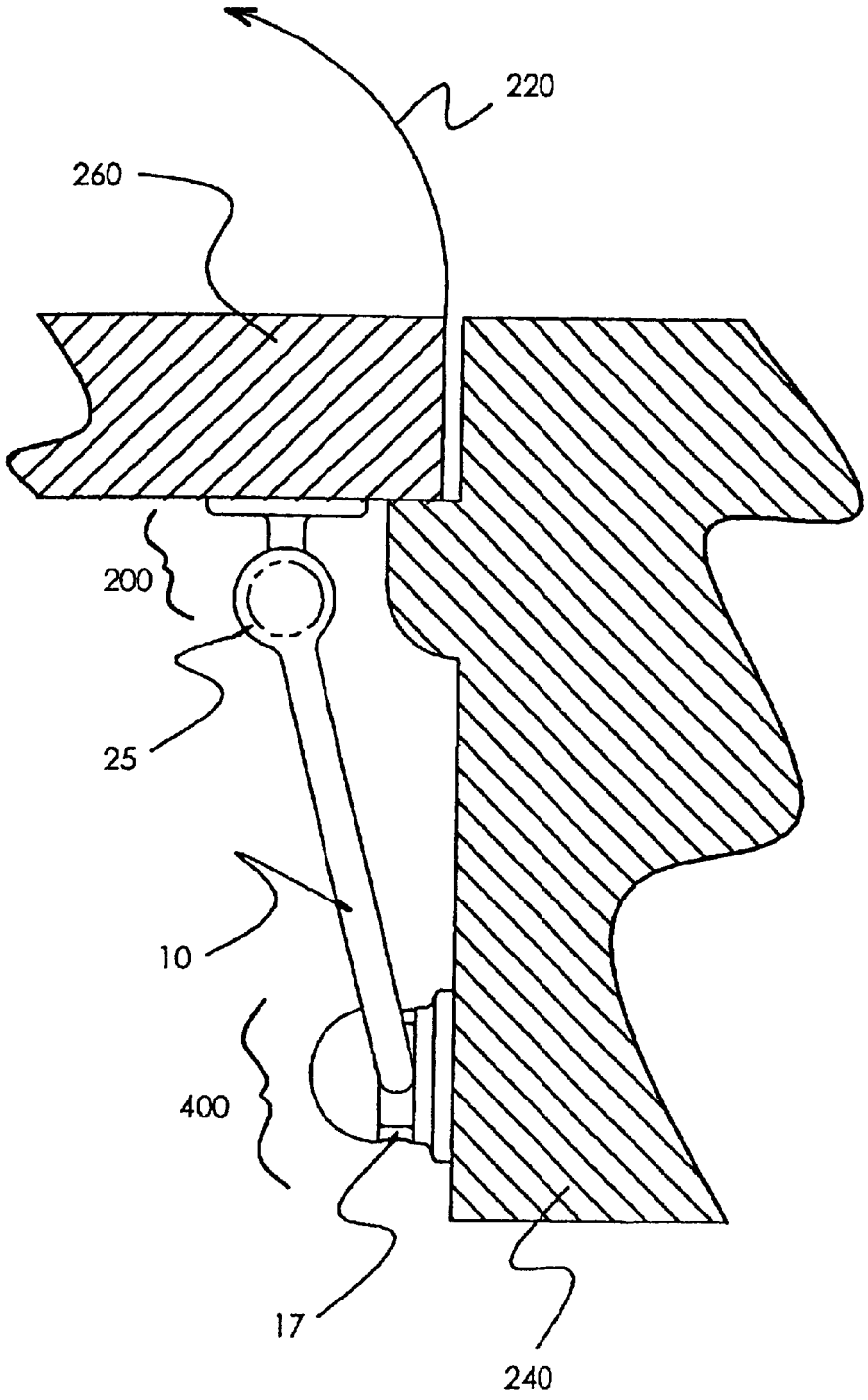
FIG. 7 is a top view of the latch version in relation to a door frame.

Referring now to FIG. 1 we see a perspective view of the invention 100. The invention 100 is comprised of a catch retaining assembly 300 and a catch assembly 200. Both assemblies 200, 300 can be constructed of metal or plastic. The catch retainer 300 is comprised of a ball retaining mounting plate 14 that has a concave ball retaining portion 18 and retaining disk 35. The ball retaining portion 18 has a vertical slot 16 that allows J shaped rod 10 to protrude and swivel vertically in one plane approximately one hundred and ten degrees and pivot horizontally approximately one hundred and eighty degrees. At one end of J shaped rod is fixedly attached a cup shaped second ball retaining portion 25. The catch 200 includes a catch plate 28 and an L shaped rod 26. The L shaped rod is attached to the catch plate 28 at one end and terminates in a second ball 22 at its opposite end. Both the catch retaining plate 14 and the catch plate 28 include apertures 31, 33, 3, 5 that allow screws 30, 32, 2, 4. to be used to attach to a door and or wall or the like. Of course other retaining means may be used such as double sided adhesive tape. An O ring 24 is located around the second ball 22. This allows for a snug fit between the interior of ball cup 25 and exterior of O ring 24. This snug fit means that there is no chance of rattling between the catch 200 and the catch retainer 300. FIG. 2 shows an exploded view of the catch retainer 300. The J shaped rod 10 includes a press fit portion 13 at one end that interfaces with the aperture 15 inside first ball 12. Alternately, a male and female threaded fit can be used in place of a press fit at portion 13 and 15. Ball 12 fits snuggly into concave portion 18 on one side and concave disk 35 on the opposite side which in turn is pressed against wall 20 as shown in FIG. 3 thereby holding the first ball 12 securely in place. FIG. 3 shows a side section view of the present invention 100. Catch 200 can be seen as screwed onto door 34. The interior of ball cup portion 25 can be clearly seen as can the O ring 24. Because catch ball 22 is spherical, it can interact with ball cup 25 at a variety of angles vertically and horizontally so that wall plate 28 can be mounted to a wall at a variety of angles. This allows the relationship between the door 34 and the wall 20 to be something other than parallel. Slot 16 keeps J shaped rod 10 from twisting thereby insuring that ball cup 25 is always in the proper orientation with respect to catch ball 22 and L shaped catch ball holding member 26. FIG. 4 shows a perspective view of the catch retainer assembly 300 where the J shaped rod 10 is rotated down to the lower limit of slot 16 and automatically centered in its rest position when not in use. FIG. 5 shows a top view of the invention 100 in use between a door 34 and a wall 20. The door 34 is hinged 40 and is in the open position so that the door opening 36 is available for entrance or exit of people, air, animals or the like. FIG. 6 shows an alternate embodiment of catch retaining assembly 400 where the one hundred and eighty degree slot 17 is parallel to wall 20 rather than perpendicular as in the version shown in FIGS. 1 through 5. This orientation allows J shaped rod 10 to swing down 19 parallel to wall 20 and door 34 thereby allowing the invention to act as a latch to hold a door or the like in the closed position rather than a catch that is meant to hold a door or the like in an open position. FIG. 7 shows a top view of the alternate embodiment described above where the catch retaining assembly 400 is mounted to a door frame 240 at a ninety degree angle to catch ball 200 mounted on door 260 and opening out as shown by radial line 220. The catch retainer arm 10 can be positioned to the right or the left to accomodate left or right opening doors. Because of the snug fit between the catch and the catch retainer as described above, the chance of rattling is significantly reduced. This feature is important when the invention is used in a boat or recreational vehicle or aircraft.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A door catch comprising:

a catch retainer assembly;

a catch;

said catch retaining assembly comprised of a rigid first ball retaining mounting plate, a first ball, a rigid J shaped rod and a second ball retaining cup shape;

said catch comprised of a door mounting plate, an L shaped rod terminating at one end in said door mounting plate and at the opposite end in a second ball, wherein said second ball includes a horizontally and circuniferentially disposed recess which accommodates an O ring, said O ring engaging snuggly with said ball retaining cup thereby creating a non rattling fit, said catch retaining assembly mounting plate and said catch mounting plate each including a plurality of screw receiving apertures;

said J shaped rod terminating at its top portion in said second ball retaining cup and at the lower portion in a ninety degree offset which terminates in said first ball;

said first ball retaining plate including a centrally disposed concave ball retaining portion, said concave portion including a vertically disposed slot capable of receiving said J shaped rod; and said ball retaining cup capable of fitting snuggly over said second ball shape so that no rattling can occur between the said retaining cup and the said second ball.

2. The door catch as claimed in claim 1 wherein said first ball retaining mounting plate is sized so that when said first ball and a concave disk are in place, and said mounting plate is attached to a wall, the said first ball is retained snuggly between said wall and said interior of said concave ball retaining portion.

3. The door catch as claim in claim 1, wherein said catch retainer assembly has a one hundred and eighty degree slot oriented at ninety degrees to that described in claim 1 so that said invention can act as a latch device for a door that is parallel to a wall or as a catch device on a door that is perpendicular to a wall or door frame.

* * * * *